US006625410B2

(12) United States Patent
Sato et al.

(10) Patent No.: US 6,625,410 B2
(45) Date of Patent: Sep. 23, 2003

(54) IMAGE FORMING APPARATUS

(75) Inventors: Masahiro Sato, Ebina (JP); Atsuyuki Kitamura, Ebina (JP); Shinichi Kuramoto, Ebina (JP); Mituo Yamamoto, Ebina (JP); Wataru Suzuki, Ebina (JP); Koichi Watanabe, Ebina (JP); Shuichi Nishide, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/068,880

(22) Filed: Feb. 11, 2002

(65) Prior Publication Data

US 2003/0053822 A1 Mar. 20, 2003

(30) Foreign Application Priority Data

Sep. 20, 2001 (JP) ..... 2001-287437

(51) Int. Cl.[7] ..... G03G 15/14
(52) U.S. Cl. ..... 399/165; 399/302; 399/308
(58) Field of Search ..... 399/302, 308, 399/298, 300, 162, 165

(56) References Cited

U.S. PATENT DOCUMENTS 5,278,613 A * 1/1994 Bisaiji et al. ..... 399/308 X
5,291,254 A * 3/1994 Shimada et al. ..... 399/298 X
5,619,313 A * 4/1997 Domoto et al. ..... 399/302 X
5,715,509 A * 2/1998 Staudenmayer et al. .... 399/308
6,115,576 A * 9/2000 Nakano et al. ..... 399/302
6,173,147 B1 * 1/2001 Nakashima et al. ..... 399/308
6,253,039 B1 * 6/2001 Nakano et al. ..... 399/302 X
6,337,967 B1 * 1/2002 Izumi et al. ..... 399/302 X

FOREIGN PATENT DOCUMENTS

JP A 6-278894 10/1994
JP 09-258626 * 10/1997
JP 11-030917 * 2/1999

* cited by examiner

*Primary Examiner*—Sophia S. Chen
(74) *Attorney, Agent, or Firm*—Oliff & Berridge, PLC

(57) ABSTRACT

In an image forming apparatus for transferring an image formed on a photoreceptor 1 onto a recording medium 3 through an intermediate transfer member 2, one of the photoreceptor 1 and the intermediate transfer member 2 is formed like a drum, the other of the photoreceptor 1 and the intermediate transfer member 2 is formed like a belt, which is wound on a plurality of tension rolls 4, and the following relationship is satisfied:

$$\sum_{n=3}^{N} a_n < x$$

where $a_n$ is the contact lengths between the other and the nth tension rolls, respectively and x is contact length between the photoreceptor 1 and the intermediate transfer member 2.

12 Claims, 5 Drawing Sheets

IMAGE FORMING APPARATUS

The present disclosure relates to the subject matter contained in Japanese Patent Application No. 2001-287437 filed on Sep. 20, 2001, which is incorporated herein by reference in its entirety.

BACKGROUND OF THE INVENTION

1. Field of the Invention

The present invention relates to an image forming apparatus, such as a copying machine and a printer, and more particularly to the improvement over the image forming apparatus for transferring an image formed on a photoreceptor onto a recording medium through an intermediate member.

2. Description of the Related Art

An image forming apparatus according to the related art, which adopts the intermediate transfer type, has been known in which an intermediate transfer belt as an intermediate transfer member is disposed to face a photosensitive drum as a photoreceptor. Toner images containing color components are primarily transferred onto the intermediate transfer belt in successive order. The transferred toner images are transferred, at a time, from the intermediate transfer belt onto a recording medium, e.g., a recording sheet of paper.

In this type of the image forming apparatus, the intermediate transfer belt is usually constructed as a belt unit in which the intermediate transfer belt is wound on a plurality of rolls and circulatively moves in a predetermined travelling direction.

In the belt unit, the intermediate transfer belt moves not straightly while being displacing in an axial direction of tension rolls that is, so-called meandering occurs. The meandering of the intermediate transfer belt is caused by variations in the parallelism among rotary shafts of the tension rolls, variations in the outside diameters of the tension rolls, and a non-uniformity of tensions caused by a variation of the periphery length of the intermediate transfer belt per se.

When the meandering occurs, transfer positions of the toner images, which are transferred onto the intermediate transfer belt in successive order, are displaced from the correct ones. As a result, there is a possibility that such image defects as color mis-registration and hue variation occur in the color image formed on the recording medium, e.g., a recording sheet.

Some measures have been taken for the meandering of the belt. One of the measures is that the end of the belt is abutted against the edge guide to position the belt in place. Another measure is that ribs are formed at the ends of the rear side of the belt to control the meandering motion of the belt. Yet another measure is that belt end positions are detected by position sensors, and the parallelism of a desired tension roll is variably adjusted according to the sensing results.

In those measures, the edge guides and ribs for abutting are provided on both ends of the belt. The position sensors for detecting both end positions of the belt are also provided at both ends of the belt. However, the belt will finally displace by variations of the parallelism and diameters of the tension rolls.

In such circumstances, the reinforcing structure for avoiding the damage of the belt by stress concentration on the butting edge guide, and bonding of the ribs are high in cost. Further, it is disadvantageous in the light of space saving that the belt width is larger than the image forming width.

To cope with this, a technique, which employs a technique for shifting the belt to one side, simplifies the structure, and stabilizes the meandering correcting performance, already has been proposed.

There has been a known technique for shifting the belt to one side in which the diameter of one tension roll is gradually varied in the axial direction to shift the belt to one side (e.g., JP-A-Hei.6-278894) and has been another known technique to incline the parallelism of a desired tension roll.

After or when it is mounted on the apparatus body, due to distortion of the belt unit, although the parallelism of each tension roll of the belt unit is kept, the tension rolls may be slanted in the same direction by the distortion.

Under the circumstances, when the technique for shifting the belt to one side (the technique for gradually varying the diameter of the tension roll or the technique for inclining the parallelism of one tension roll) is employed, depending on the distortion direction of the belt unit, it is feared that the belt is directed to a side which is opposite to the side as intended.

To set the gradual variation of the diameter of the tension roll and the inclination of the parallelism of the tension rolls in consideration with the twist of the belt unit, the variation and inclination must be set large. If the variation and inclination are set too large, this becomes cause of tension wrinkle so that it is feared to have disadvantage in performance of transfer.

Incidentally, such problems does not only arise in the technique for shifting the belt to one side, but also similarly arise in the technique for restricting the meandering of the belt at both side because in many cases, the belt is shifted to any of sides.

Accordingly, the present invention has been made for solving the above problems and provides the following technique: even when a twist occurs in the belt in a state that the parallelism of a tension roll of the belt is kept, the belt may be shifted to one side in a desired direction without causing tension wrinkles and the like in the belt, and hence, the meandering control of the belt is alleviated in load. With this technique, the invention provides an image forming apparatus which can reduce the color mis-registration and can perform good image formation.

SUMMARY OF THE INVENTION

According to the invention, there is provided an image forming apparatus having a photoreceptor, an intermediate transfer member, and a plurality of tension rolls, in which one of the photoreceptor and the intermediate transfer member is formed like a drum, in which the other of the photoreceptor and the intermediate transfer member is formed like a belt, which is wound on the plurality of tension rolls, and in which the following relationship is satisfied:

$$\sum_{n=3}^{N} a_n < x$$

$a_n$ is the contact lengths between the other and the n tension rolls, respectively and x is contact length between the photoreceptor and the intermediate transfer member.

DESCRIPTION OF THE INVENTION

According to the present invention, as shown in FIG. 1A, there is provided an image forming apparatus for transferring an image formed on a photoreceptor 1 onto a recording medium 3 through an intermediate transfer member 2, in which one of the photoreceptor 1 and the intermediate transfer member 2 is shaped like a drum, while the other is shaped like a belt, which is put on a plurality of tension rolls 4, and the following relation is satisfied:

$$a+b+c+\ldots<x$$

where a, b, c, . . . are contact lengths between the other of the intermediate transfer member 2 and photoreceptor 1, which are formed in a belt like shape, and each of tension rolls 4 and x is contact length between the intermediate transfer member 2 and the photoreceptor 1.

It should be understood that the present invention thus technically implemented is applied to a variety of image forming apparatus. It is preferable that the invention is applied to the color image forming apparatus since remarkable technical effects are produced in such applications. However, it should be understood that the invention may be applied to the monochromatic image forming apparatus, as a matter of course.

In relation to a mode of the photoreceptor 1 and the intermediate transfer member 2, one of them is formed in a drum shape, and the other is formed in a belt shape. A belt-like intermediate transfer member 2 is used for a drum-like photoreceptor 1 (the combination of them is illustrated in FIG. 1). A drum-like intermediate transfer member 2 is used for a belt-like photoreceptor 1.

Further, as a measure for the meandering of a belt like member (hereinafter, referred to simply as a belt), in view of simplification of the structure of the apparatus, it is preferable that the intermediate transfer member 2 or photoreceptor 1, which is formed in the belt like shape, adopts a technique for shifting the belt to one side. It should be understood that the invention is not limited to the technique for shifting the belt to one side. The invention also includes the technique for restricting the meandering at both sides of the belt. This is because in the technique for restricting the meandering at the both ends of the belt, in many cases, the belt also is intended to shift to any of the sides due to error in a part/assemble and therefore there is enough worth to use the invention.

In the invention, to specify a contact region (contact length x) between the photoreceptor 1 and the intermediate transfer member 2, it is taken into account to a balance between an inside of the belt and an outside of the belt and an axis of the drum like shaped member (hereinafter referred to as a drum) is inclined, whereby the contact length in the inside of the belt (the contact length in relation to the tension roll 4) is made larger than the contact length in the outside of the belt (the contact length in relation to the drum) so that a shift direction of the belt can be restricted uniformly.

To be more specific, for example, in an example shown in FIG. 1, when twist occurs in a state that the parallelism among the tension rolls 4 of the belt-like intermediate transfer member 2 (belt) is kept, in a case where only the tension rolls 4 being in contact with the inner surface of the belt 2 are provided, all the tension rolls 4 are twisted in the same direction to apply axial directional forces FR in the same direction to the belt 2 as shown in FIG. 1B. However, when the drum-like photoreceptor (drum) 1 being in contact with the outer periphery of the belt 2 is twisted in the same direction as that of the tension rolls 4, an axial directional force FD in an opposite direction to that of the tension rolls 4 being in contact with the inner surface of the belt 2 is applied to the belt 2.

When the belt unit is thus twisted, in a case where only the tension rolls 4 being in contact wit the inner surface of the belt 2 is provided, it is feared that a force (the force FR in FIG. 1B) to shift the belt to one side in a opposite direction to that as intended.

On the other hand, the drum 1 being in contact with the outer periphery of the belt 2 produces a force (the force FD in FIG. 1B) in the opposite direction to that of the tension rolls 4 being in contact with the inner surface of the belt 2.

A force to shift the belt 2 to one side is canceled in a state that a+b+c+ . . . =x, where a, b, c, . . . are each contact length between each of tension rolls 4 and the belt 2 and x is a contact length between a surface of the drum 1 and of the belt 2.

In order to shift the belt 2 to the intended direction, it is necessary to make a+b+c+ . . . <x or a+b+c+ . . . >x. However, the condition "a+b+c+ . . . >x" implies that the tension rolls 4 on the inner surface of the belt are all slanted to the intended direction. It is very difficult to satisfy this condition. Accordingly, the invention employs the condition "a+b+c+ . . . <x" and adopts a technique for shifting the belt 2 to one side by slanting the drum 1 being in contact with the outer periphery of the belt 2.

The photoreceptor 1 and the intermediate transfer member 2 maybe driven by separate drive systems, respectively. Since the photoreceptor 1 and the intermediate transfer member 2 are brought into contact with each other over a relatively large area, one of the photoreceptor 1 and the intermediate transfer member 2 may be used as a drive source and the other may be rotated following the drive source.

In this mode, one of the drive mechanisms can be omitted and the size and cost of the image forming apparatus are reduced correspondingly. Further, an effect of shifting the belt (e.g., the belt-like intermediate transfer member 2) to one side is more effectively produced.

The other of intermediate transfer member 2 and the photoreceptor 1, which is belt like, may be made of an appropriate material such as resin, rubber, or the like. Preferably, the other of the intermediate transfer member 2 and the photoreceptor 1, which is belt like, includes at least an elastic layer.

With this structure, the friction coefficient of the belt (e.g., belt-like intermediate transfer member 2) is increased, whereby the belt can be effectively shifted to one side.

To secure a satisfactory cleanness property for soil on the belt surface, preferably, the other of the intermediate transfer member 2 and the photoreceptor 1, which is belt like, has a multi-layer structure including a release layer formed at least on the surface of the elastic layer.

Furthermore, preferably, the elastic layer has the Young's modulus in a range of from 15 Mpa to 80 MPa.

An appropriate number of tension rolls 4 for the belt may be used. To lessen or stabilize the influence by the meandering of the belt, it is preferable to put the other of the photoreceptor 1 and intermediate transfer member 2, which is belt like, on at least four or more number of tension rolls 4.

In this mode, the four tension rolls 4 are used as a pair of tension rolls for positioning with respect to the drum-like counter member, or used as backup rolls for the secondary transfer and the cleaning.

In view of effectively performing the operation of shifting the belt to one side, it is preferable that the one of the drum-like photoreceptor 1 and intermediate transfer member 2, which is drum like, are disposed at a location where a distance between the tension rolls 4 for the one of the intermediate transfer member 2 and the photoreceptor 1, which is belt like, is the longest among distances between the tension rolls.

The feature of the "location where the distance between the tension rolls 4 is the longest" lessens the influence of the operation of shifting the belt to one side by the adjacent tension rolls 4 on the operation of shifting the belt (e.g., intermediate transfer member 2) to one side by tilting the drum (e.g., drum-like photoreceptor 1).

The present invention is based on the construction including the photoreceptor 1 and the intermediate transfer member 2. The invention may also be applied to a construction including the photoreceptor and a recording medium transporting member for transporting a recording medium so long as one of the photoreceptor and the recording medium transporting member is shaped like a drum, and the other is shaped like a belt.

DESCRIPTION OF THE PREFERRED EMBODIMENTS

The preferred embodiments of the present invention will be described with reference to the accompanying drawings.

Figure 7:
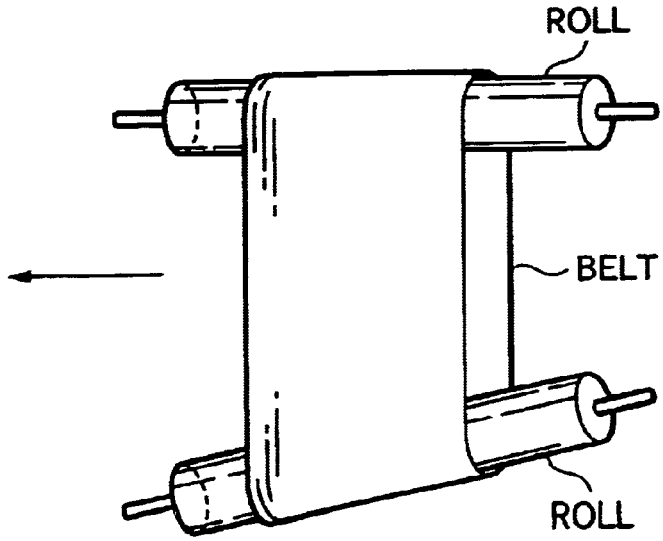
FIG. 7 is a diagram to explain an expression "shifting belt to one side".
Figure 8:
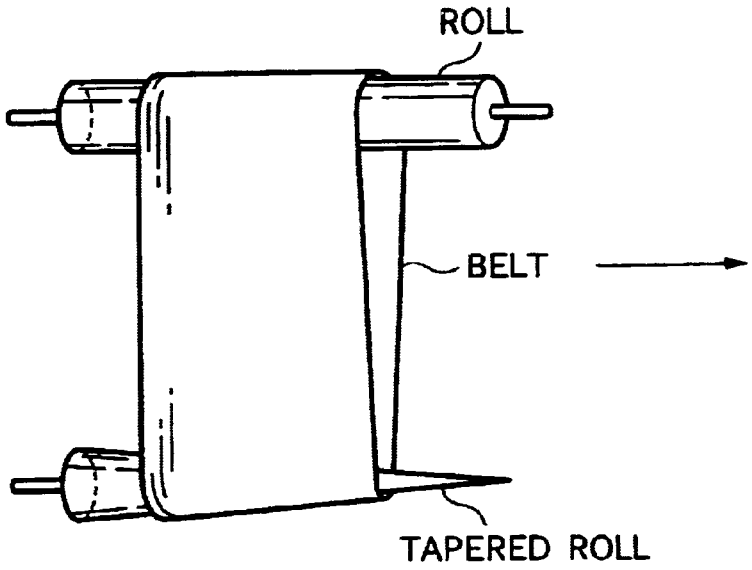
FIG. 8 is another diagram to explain the expression "shifting belt to one side".

In the invention, an expression "shifting belt to one side" and similar expression include that alignment (parallelism) among rolls are inclined by design to shift a belt to one side (as shown in FIG. 7, in which the belt is shifted in an arrow direction) or that at least one of rolls is formed in a taper roll to shift a belt from thick portion of the roll to thin portion of the roll (as shown in FIG. 8, in which the belt is shifted in an arrow direction).

<Embodiment 1>

Figure 1A:
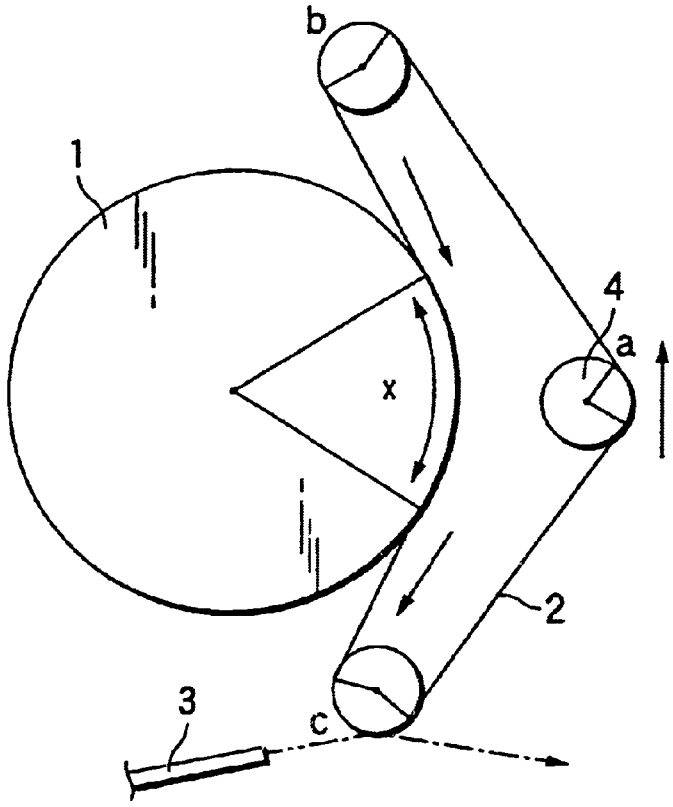
FIG. 1A is a diagram showing an outline of an image forming apparatus constructed according to the present invention.
Figure 1B:
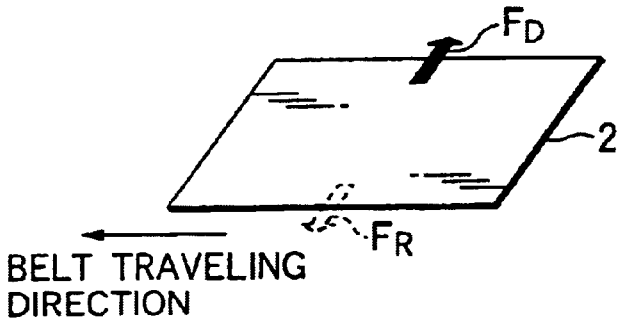
FIG. 1B is a explanatory diagram showing a process of shifting the belt according to the invention to one side.
Figure 2:
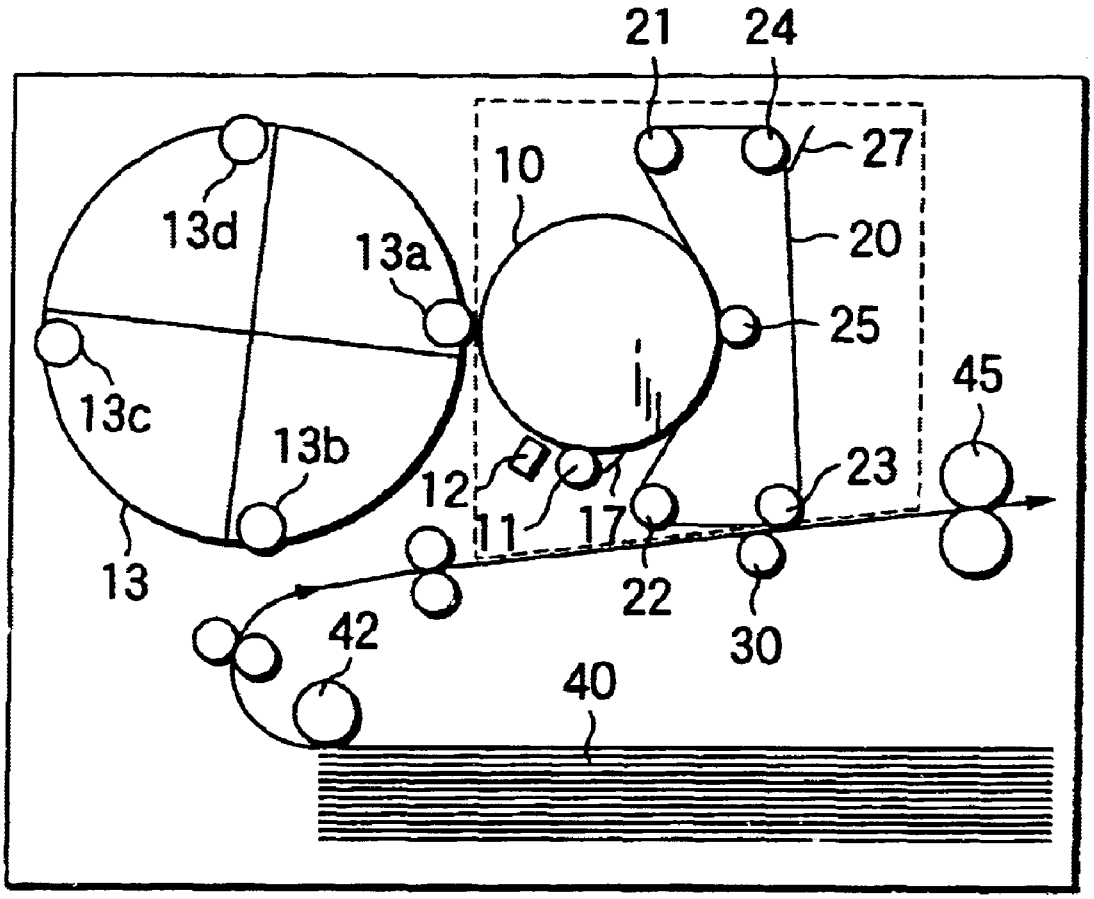
FIG. 2 is a diagram showing an embodiment 1 of an image forming apparatus to which the invention is applied.

FIG. 2 is a diagram showing an embodiment 1 of an image forming apparatus to which the invention is applied.

In the figure, the image forming apparatus includes a photosensitive drum 10 and an intermediate transfer belt 20 which is brought into contact with the photosensitive drum 10 over a predetermined region and in conformity with a shape of the photosensitive drum 10 to transfer a toner image from the photosensitive drum 10 onto the intermediate transfer belt 20.

In the embodiment, the photosensitive drum 10 includes a photosensitive layer whose resistance decreases when the the photosensitive layer is exposed to light. A charging unit 11, an exposure unit 12, a rotary developing unit 13, and a cleaning unit 17 are disposed around the photosensitive drum 10. The charging unit 11 charges the photosensitive drum 10. The exposure unit 12 writes electrostatic latent images of color components (black, yellow, magenta, and cyan in the embodiment) onto the charged photosensitive drum 10. The rotary developing unit 13 visualizes the latent images of the color components formed on the photosensitive drum 10 with toners of those color components. The cleaning unit 17 cleans (removes) residual toners on the intermediate transfer belt 20 and the photosensitive drum 10.

A charging roll, for example, is used as a charging unit 11 in the embodiment, but a charging device such as corotron may be used as a charging unit 11.

The exposure unit 12 may be any device so long as the device can write an image onto the photosensitive drum 10 by light. A print head using LEDs is used in the embodiment. However, the print head of the invention is not limited to the above. Any type of print heads such as a print head using EL (electroluminescent) elements and a scanner which scan with a laser beam by using a polygon mirror may be selected appropriately.

The rotary developing unit 13 has developing devices 13*a* to 13*d*, which are rotatably mounted thereon and contain the color component toners. The developing device may be any device so long as the device can attach each color component toner to a portion on the photosensitive drum 10 at which potential drops due to the exposure. There is not any limitation on the shape and particle diameter of toner particles. Any type of tone particles may be used so long as the toner particles are exactly attracted to the electrostatic latent image on the photosensitive drum 10. The rotary developing unit 13 is used in the embodiment. However, four separate developing units may also be employed.

An appropriate cleaning system may be used as a cleaning unit 17 so long as the cleaning system can clean (remove) the residual toner on the photosensitive drum 10. The cleaning system may employs a blade cleaning device. Where the toner having a high transfer rate is used, the cleaning unit 17 may be omitted.

A resin material such as polyimide or polycarbonate resin may be appropriately used for the intermediate transfer belt 20. In order to effectively suppress occurrence of image quality defects such as hollow characters, it is necessary to decrease the contact surface pressure in relation to the photosensitive drum 10. In the light of the walkless and tensionerless, it is preferable to use a rubber belt member in which elastic rubber is used for a base substance (elastic layer) 201, as shown in FIG. 4B.

In this case, it is necessary that the elastic rubber base substance (elastic layer) 201 of the intermediate transfer belt 20 has a volume resistance (e.g., in a range of from $10^6$ Ω to $10^{10}$ Ω), which is required to maintain the satisfactory transfer performance.

Since the intermediate transfer belt 20 has the elastic rubber base substance (elastic layer) 201, a friction coefficient of the obverse and reverse surfaces of the intermediate transfer belt 20 is relatively large. Accordingly, a shift-to-one-side effect to be described later is made more effective.

Figure 4:
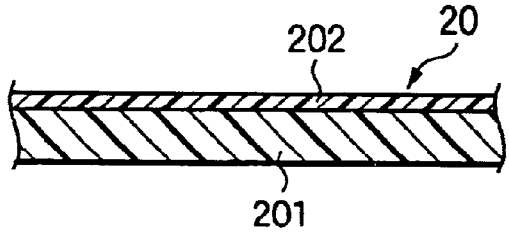
FIG. 4 is a diagram showing a structure of the intermediate transfer belt.

Furthermore, taking cleanness property in a case where a foreign substance is attached to the obverse surface of the intermediate transfer belt 20 into consideration, the intermediate transfer belt 20 preferably have a multi-layer structure in which a release layer 202 such as a fluoride resin layer is laminated on the surface of the elastic rubber base substance (elastic layer) 201, as shown in FIG. 4.

In order to keep good transfer performance, it is preferable that the elastic layer 201 has Young's modulus in a range of from 15 MP to 80 MP.

Examples of preferable materials of the elastic rubber base substance are urethane rubber (soft type: 16.9 Mpa), urethane rubber (hard type: 78.6 MPa), and chloroprene rubber (16.2 MPa).

Examples of undesirable materials are PET (1.47 GPa) and PC (1.96 GPa).

Figure 3:
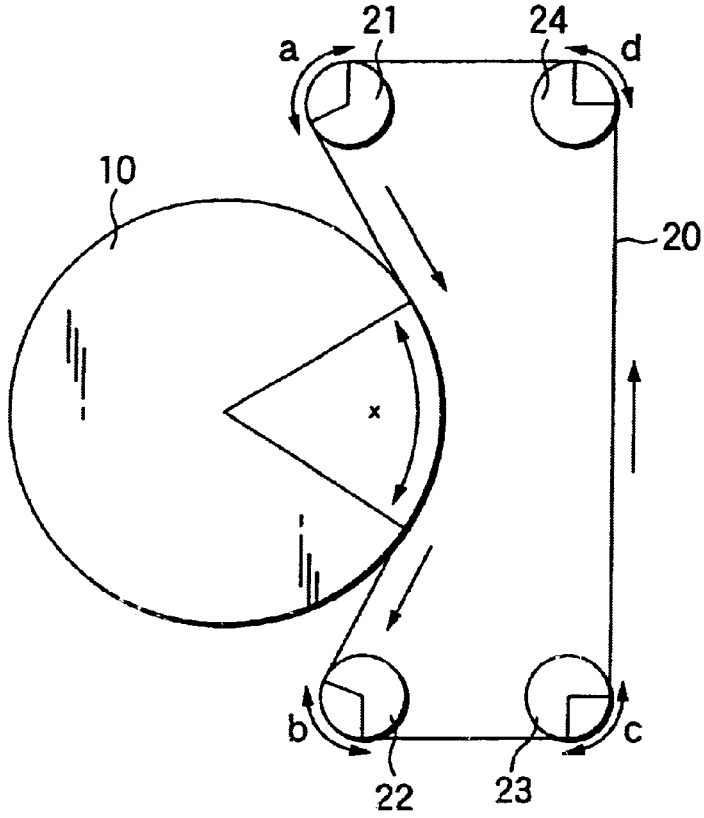
FIG. 3 is a diagram showing a layout between a photosensitive drum and an intermediate transfer belt in the embodiment.

In the embodiment, as shown in FIGS. 2 and 3, the intermediate transfer belt 20 is wound around tension rolls 21 to 24 and is disposed to close contact to and along the surface of the photosensitive drum 10, which is positioned between the rotary developing unit 13 and the cleaning unit 17, over predetermined contact region. As shown in FIG. 3, the intermediate transfer belt 20 travels in an arrow direction.

In the embodiment, the photosensitive drum 10 and the intermediate transfer belt 20 has drive sources, respectively. The tension roll 21 of the four tension rolls 21 to 24 of the intermediate transfer belt 20, which is located in the most upstream side in relation to a transfer position at which the toner image formed on the photosensitive drum 10 is transferred onto the intermediate transfer belt 20, serves as a drive roll. Further, a winding angle of the tension roll 21 is set to be the largest in the winding angles of the tension rolls. The tension roll 22 located in the downstream in relation to the transfer position is a follower roller and restricts the contact region between the intermediate transfer belt 20 and the photosensitive drum 10. The tension roll 22 is a roll, which is fixed its position. The tension roll 23 located in the downstream of the tension roll 22 is a follower roll and also serves as a back roll (earthing in this embodiment) for secondary transfer. The tension roll 24 is a follower roll and also serves as a backup roll of a belt cleaning unit 27. In the embodiment, the size of the tension rolls 21 to 24 may be selected as desired.

In the embodiment, the following relation is satisfied:

$$a+b+c+d<x$$

where x is the contact region (a contact length) between the photosensitive drum 10 and the intermediate transfer belt 20 and a, b, c, and d are contact lengths between the tension rolls 21 to 24 and the intermediate transfer belt 20, respectively, as shown in FIG. 3.

In order to shift the intermediate transfer belt 20 to done side, the parallelism and/or the horizontality of the tension rolls 21 to 24 is appropriately varied in advance.

It is noted that "the contact length" means a length from a point where a surface of the belt and a surface of the roll start to contact with each other to a point where the surface of the belt and the surface of the roll end to contact with each other. It is also noted that "the wiring angle" means a value, which is a ratio of the contact length to the whole peripheral length of the roll and is converted in terms of angle.

The reason why the four tension rolls 21 to 24 are used for the intermediate transfer belt 20 in the embodiment will be described as follows. In order to suppress undulation of the surface of the intermediate transfer belt 20 as much as possible and in order to stabilize movement of the intermediate transfer belt 20 in an axial direction thereof from the photosensitive drum 10, two tension rolls 21 and 22, which are disposed in the upstream and downstream in relation to the transfer position, respectively, is required to determine positional relationship between the photosensitive drum 10 and the intermediate transfer belt 20.

If the belt cleaning unit 27 being in contact with the outer periphery of the intermediate transfer belt 20 and a secondary transfer roll 30 are located so as not to face tension rolls, forces making the intermediate transfer belt 20 to move in the axial direction are not stable and therefore, this may become cause of the meandering of the intermediate transfer belt 20.

To lessen or stabilize its influence, it is necessary that those devices (belt cleaning unit 27 and secondary transfer roll 30) are disposed to face the tension rolls, respectively.

Taking it into consideration that in view of space and ensuring performance of each device, it is difficult to dispose the devices to face one tension roll, the tension rolls 23 and 24 are necessary for the belt cleaning unit 27 and the secondary transfer roll 30, respectively.

Accordingly, it is preferable to use at least four tension rolls 21 to 24 as a tension roll to support the intermediate transfer belt 20 in a stretching fashion.

When the intermediate transfer belt 20 is brought into contact with the photosensitive drum 10 as shown in FIG. 2, as distances between the photosensitive drum 10 and the tension rolls 21 and 22, which is located in the upstream and downstream in relation to the photosensitive drum 10 are longer, an operation to correct the meandering of the intermediate transfer belt 20 at the photosensitive drum 10 side is more stable.

For this reason, in the embodiment, it is preferable that the photosensitive drum 10 is brought into contact with a location where the axis-to-axis distance between the upstream and downstream tension rolls 21 and 22 is the longest.

Further, in the embodiment, the primary transfer roll 25 is provided at a part of the contact region where the intermediate transfer belt 20 is in close contact with the photosensitive drum 10 in a state that the primary transfer roll 25 is in contact with the back side of the intermediate transfer belt 20. The primary transfer belt is applied a predetermined primary transfer bias voltage.

At a part of the intermediate transfer belt 20 where the intermediate transfer belt 20 faces the tension roll 23, the secondary transfer roll 30 as a secondary transfer member is disposed to face the tension roll 23 as a backup roll. For example, a predetermined secondary transfer bias voltage is applied to the secondary transfer roll 30 and the tension roll 23 also serving as a backup roll is earthed.

A recording medium 40 such as a recording sheet of paper is stored in a paper supply tray (no shown). The recording medium 40 is fed forward by a feed roll 42, guided to a secondary transfer position between the secondary transfer roll and the intermediate transfer belt 20, and transported to a fixing unit 45.

An operation of the image forming apparatus according to the embodiment will be described.

In the embodiment, toner images of each color components are successively formed on the photosensitive drum 10, are transferred onto the intermediate transfer belt 20 at the contact region (primary transfer position), and are simultaneously transferred onto the recording medium 40 at the secondary transfer position.

During the image forming process, the photosensitive drum 10 and the intermediate transfer belt 20 are disposed in contact with each other over a relatively wide contact region (contact length x) and are elastically pressed by the elastic rubber belt member. Therefore, a tuck surface pressure between the photosensitive drum 10 and the intermediate transfer belt 20 is not so high. Further, the toner images are covered in/by the elastic rubber belt member and are primarily transferred from the photosensitive drum 10 onto the intermediate transfer belt 20.

At this time, the images transferred onto the intermediate transfer belt 20 are free from image quality defects caused by the high tuck surface pressure, such as hollow character. Accordingly, the images are transferred at high transfer rate and hence a color image quality formed on the recording medium 40 is kept to be excellent.

In the embodiment, after or when the belt unit having the intermediate transfer belt 20 and the tension rolls 21 to 24 is mounted to the apparatus body, if the belt unit is distorted, the parallelism of the tension rolls 21 to 24 of the belt unit is kept; however, sometimes the tension rolls 21 to 24 may be slanted in the same direction by the twist.

In this case, if the tension rolls 21 to 24 are slanted, it is feared that the intermediate transfer belt 20 is skewed in an unintended direction.

However, in the embodiment, the contact length x of the intermediate transfer belt 20 along which the intermediate transfer belt 20 is in contact with the photosensitive drum 10 is selected to be larger than the sum of the contact lengths (a+b+c+d) of the tension rolls 21 to 24, which are in contact with the inner side of the intermediate transfer belt 20. With this unique feature, it is possible to predict a twist of the belt unit and to incline the photosensitive drum 10 in a predetermined direction, and as a result, the intermediate transfer belt 20 can be shifted to one side in an intended direction.

<Embodiment 2>

Figure 5:
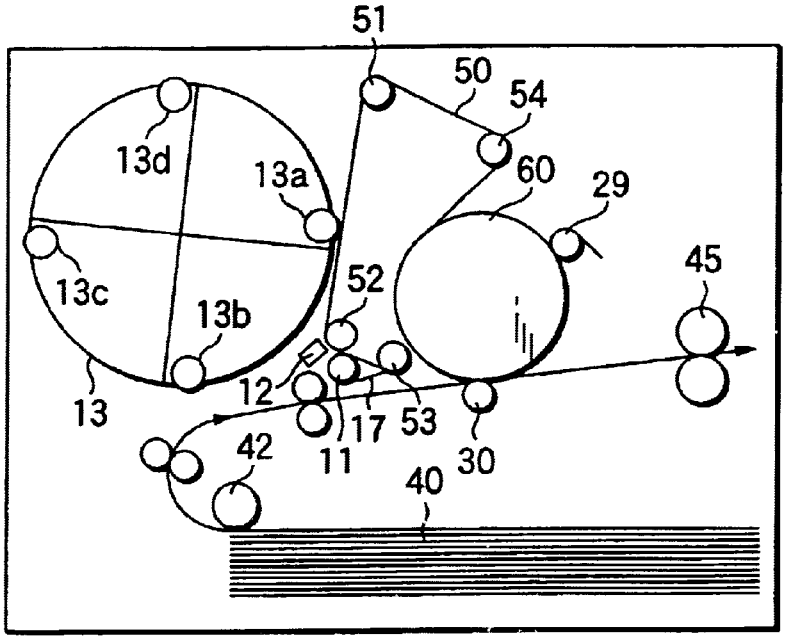
FIG. 5 is a diagram showing an embodiment 2 of an image forming apparatus to which the invention is applied.

FIG. 5 is a diagram showing an embodiment 2 of an image forming apparatus to which the invention is applied.

In the figure, the embodiment 2 is substantially the same as the embodiment 1 in the basic construction of the image forming apparatus except that the embodiment 2 includes a photosensitive belt 50 and an intermediate transfer drum 60 which is brought into contact with the photosensitive belt 50 over a predetermined region to transfer the toner image from the photosensitive belt 50 thereto.

The photosensitive belt 50 includes four tension rolls 51 to 54, for example, and is brought into close contact with and along the surface of the intermediate transfer drum 60 over a predetermined contact region.

The embodiment is arranged so as to satisfy the following relation:

$$a+b+c+d<x$$

where x is the contact length between the photosensitive belt 50 and the intermediate transfer drum 60 and a, b, c and d are the contact lengths between the tension rolls 51 to 54 and the photosensitive belt 50, respectively.

In the instant embodiment, portions, which are similar to the portions in the embodiment 1, are designated by like reference numerals used in the embodiment 1 and explanation therefor in detail are omitted. Reference numeral 29 denotes a drum cleaning unit.

According to the embodiment, the photosensitive belt 50 can be shifted to one side in an intended direction by slanting the shaft of the intermediate transfer drum 60 in a predetermined direction.

Thus, also in the instant embodiment, a certain level of rigidity is secured for the unit of the photosensitive belt 50 and the intermediate transfer drum 60. In this state, a twist of the photosensitive belt 50 is predicted and a structure can be designed such that the photosensitive belt 50 is not shifted to one side in the opposite direction to the intended direction.

<Embodiment 3>

The present embodiment is an embodiment in which in FIG. 2, the photosensitive drum 10 serves as a drive source and the intermediate transfer belt 20 is rotated following the photosensitive drum 10 through a contact region therebetween.

The other construction of the present embodiment is the substantially same as constituent elements described in the embodiment 1.

In the instant embodiment, a unique drive mechanism of the intermediate transfer belt 20 is omitted. However, the intermediate transfer belt 20 may stably be rotated to follow the photosensitive drum 10. The embodiment more lessens the inherent periphery speed difference in comparison with a structure in which each has a dedicated drive source.

Specifically, when the photosensitive drum 10 and the intermediate transfer belt 20 have the drive sources, respectively, rotation errors of the drive sources and errors of the drive force transfer systems cause the periphery speed difference therebetween, so that the photosensitive drum 10 and the intermediate transfer belt 20 slip one on the other. When the slip is present, an effect to shift the intermediate transfer belt 20 to one side by the photosensitive drum 10 becomes weak and it is feared to fail to obtain desired performances.

To cope with this, in the embodiment, the photosensitive drum 10 only has the drive source. The intermediate transfer belt 20 is rotated following the photosensitive drum 10. With this structure, the periphery speeds of them are equal to each other. Accordingly, the intermediate transfer belt 20 may be shifted to one side more effectively.

Particularly, in the embodiment, rubber is used for the base substance (elastic layer 201) of the intermediate transfer belt 20 and the elastic layer 201 includes a material whose Young's modulus is in a range of from 15 Mpa to 80 Mpa. If so done, the follower rotation is more stabilized.

The embodiment employs the follower type for the embodiment 1. However, the embodiment is not limited to this. For example, the embodiment 2 may be modified such that the intermediate transfer drum 60 is used as a drive source and the photosensitive belt 50 is rotated following the intermediate transfer drum 60 through the contact region (contact length x) therebetween.

<Embodiment 4>

Now, an explanation will be given on the embodiment 4 with reference to FIG. 6.

It is noted that parts, which is similar to the parts described in the above embodiments, are assigned the same reference numerals and explanation on the parts in detail will be omitted for simplicity.

In this embodiment, an image forming apparatus has a photosensitive drum 10, a charging unit 11, an exposure unit 12, a cleaning unit 17, an intermediate transfer belt 20, a secondary transfer roll 30, a fixing unit 45, tension rolls 61 to 65, a first transfer roll 66, a cleaning roll 67, a bias charging roll 68, and developing units 70C, 70M, 70Y, and 70K. The tension rolls 61 to 65 and the first transfer roll 66 are similar to the tension rolls and the first transfer roll described in other embodiments. Each of developer units 70C, 70M, 70Y, and 70K includes a toner of each color component (for example, Cyan, Magenta, Yellow, and Black) and supplies the toner to visualize an electrostatic latent image formed on the photosensitive drum 10.

Figure 6:
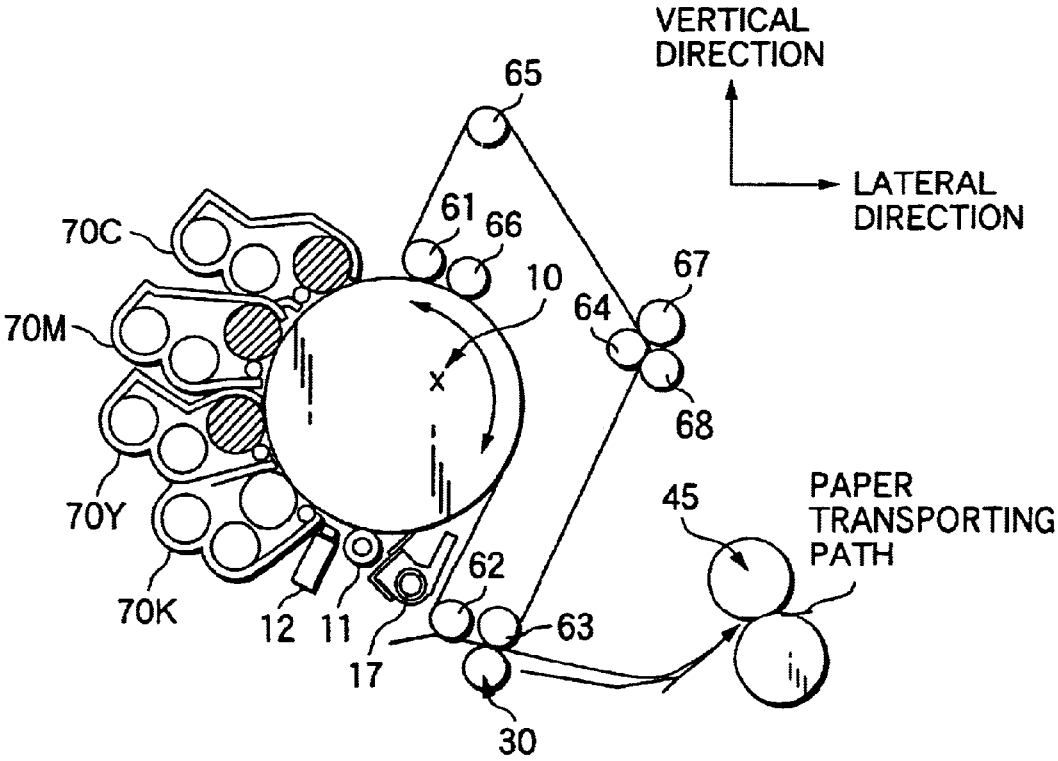
FIG. 6 is a diagram showing an embodiment 4 of an image forming apparatus to which the invention is applied.

As shown in FIG. 6, a region X in which the photosensitive drum 10 and the intermediate transfer belt 20 contact with each other is present between the developing unit 70C and the cleaning unit 17. It is noted that in this embodiment, the relationship between the length of the region X and sum of contact lengths between the intermediate transfer belt 20 and the tension rolls 61 to 65 is satisfied as with other embodiments. In other words, the length of the region X is larger than the sum of the contact lengths between the intermediate transfer belt 20 and the tension rolls 61 to 65.

To rotate the photosensitive drum 10 and the intermediate transfer belt 20 together with each other, it is necessary to set the length of the region X as long as possible. The inventors of the present invention found that it was necessary that a contact length of the region X along the outer periphery of the photosensitive drum 10 was more than 50% of a distance between the developing unit 70C and the cleaning unit 17 along the outer periphery of the photosensitive drum 10. More preferably, the contact length of the region X was more than 80% of the distance. It is noted that even if the diameter of the photosensitive drum 10 is changed, the above described ratio is not changed. With this structure, the photosensitive drum 10 and the intermediate transfer belt 20 can always stably rotate.

Furthermore, the intermediate transfer belt 20 may be disposed to be opposite to the developing units 70C, 70M, 70Y, and 70K through the photosensitive drum 10. With this structure, the more miniaturization of the image forming apparatus can be accomplished.

In view of layout, it is necessary that the intermediate transfer belt 20 has the peripheral length to some extent. If the tension rolls 61 to 65 are arranged in a lateral direction (shown in FIG. 6), the intermediate transfer belt 20 takes up much space due to positional relationship between a paper transporting member (not shown) for transporting a recording medium and the intermediate transfer belt 20. Therefore, as shown in FIG. 6, arranging the tension rolls 61 to 65 in a vertical direction in relation to the paper transporting path has a beneficial effect on the miniaturization of the image forming apparatus.

The photosensitive drum 10 and the intermediate transfer belt 20 may be unitized to have a beneficial effect on attachment/detachment of the unit and accuracy maintenance of the pressure-contact region.

As seen from the foregoing description, one of the photoreceptor 1 and the intermediate transfer member 2 is shaped like a drum, while the other is shaped like a belt. A contact region between the one and the other is set in accordance with a relation between a contact length between the outer side of the belt and the one and sum of contact lengths between the inner side of the belt and tension rolls. A movement of the drum-like member approaching to the belt-like member is preferentially used. With this feature, even when a twist occurs in the belt in a state that the parallelism among the tension rolls of the belt is kept, the belt may be shifted to one side in a desired direction without causing tension wrinkle in the belt. Accordingly, the meandering control of the belt is alleviated in load and the color mis-registration of an image is prevented to occur, whereby a good image formation without the color mis-registration can be produced. The feature more effectively reduces the size of the image forming apparatus.

What is claimed is:

1. An image forming apparatus comprising:

a photoreceptor;

an intermediate transfer member; and a plurality of tension rolls;

wherein one of the photoreceptor and the intermediate transfer member is formed like a drum;

wherein the other of the photoreceptor and the intermediate transfer member is formed like a belt, which is wound on the plurality of tension rolls; and wherein the following relationship is satisfied:

$$\sum_{n=3}^{N} a_n < x$$

where $a_n$ is the contact lengths between the other and the nth tension rolls, respectively and x is contact length between the photoreceptor and the intermediate transfer member.

2. The image forming apparatus according to claim 1, wherein the other adopts system in which the belt is shifted to one side.

3. The image forming apparatus according to claim 1, wherein one of the photoreceptor and the intermediate transfer member serves as a drive source; and wherein the other the photoreceptor and the intermediate transfer member serves as a follower member.

4. The image forming apparatus according to claim 1, wherein the other of the photoreceptor and the intermediate transfer member, which is formed like a belt, comprises at least an elastic layer.

5. The image forming apparatus according to claim 4, wherein the other of the photoreceptor and the intermediate transfer member, which is formed like a belt, at least has a multi-layer structure in which a release layer is layered on a surface of the elastic layer.

6. The image brining apparatus according to claim 4, wherein the elastic layer has a Young's modulus in a range of from 15 Mpa to 80 MPa.

7. The image forming apparatus according to claim 1, wherein the other of the photoreceptor and the intermediate transfer member, which is formed like a belt, is wound on at least four tension rolls.

8. The image forming apparatus according to claim 1, wherein the one of the photoreceptor and the intermediate transfer member, which is formed like a drum, is disposed at a location where a distance between the tension rolls is the longest among distances between the tension rolls.

9. The image forming apparatus according to claim 1, further comprising:

a developing unit is disposed to face to the photoreceptor; and a cleaning unit is disposed to face to the photoreceptor and to be opposed to the developing unit through the photoreceptor, wherein the photoreceptor is formed like a drum; and wherein x is larger than about 50% of the peripheral distance of the photoreceptor between the developing unit and the cleaning unit.

10. The image forming apparatus according to claim 1, wherein the photoreceptor and the intermediate transfer member is unitized as a detachable cartridge.

11. The image forming apparatus according to claim 1, further comprising a plurality of developing units disposed to face the photoreceptor, wherein the intermediate transfer member is disposed to be opposite to the plurality of developing units.

12. The image forming apparatus according to 11, wherein the uppermost tension roll is located at a position higher than the photoreceptor in a vertical direction; and wherein the lowermost tension roll is located at a position lower than the photoreceptor in the vertical direction.

* * * * *